US005383245A

United States Patent [19]

Droeser

[11] Patent Number: 5,383,245

[45] Date of Patent: Jan. 24, 1995

[54] ROLLER BRUSH FOR SWEEPING MACHINE WITH CASSETTES HAVING METAL REINFORCED MOUNTING PLATE

[75] Inventor: Walter Droeser, Västerås, Sweden

[73] Assignee: Filippa i. Västeras Handelsbolag, Västeras, Sweden

[21] Appl. No.: 39,279

[22] PCT Filed: Sep. 10, 1991

[86] PCT No.: PCT/SE91/00596

§ 371 Date: Apr. 19, 1993

§ 102(e) Date: Apr. 19, 1993

[87] PCT Pub. No.: WO92/06612

PCT Pub. Date: Apr. 30, 1992

[30] Foreign Application Priority Data

Oct. 18, 1990 [SE] Sweden ..... 9003329

[51] Int. Cl.[6] ..... A46B 13/02

[52] U.S. Cl. ..... 15/183; 15/179; 15/200; 15/191.1; 451/465

[58] Field of Search ..... 15/179, 181, 182, 183, 15/190, 191.1, 200; 51/332, 334, 364, 370

[56] References Cited

U.S. PATENT DOCUMENTS

| | | | |
|---|---|---|---|
| 2,721,348 | 10/1955 | Baydenburgh | 15/183 |
| 2,734,212 | 2/1956 | Koch | 15/183 |
| 3,241,172 | 3/1966 | Tilgner | 15/183 |
| 4,302,863 | 12/1981 | Droeser . | |
| 4,485,514 | 12/1984 | Droeser | 15/181 |
| 4,498,210 | 2/1985 | Drumm . | |
| 4,538,319 | 9/1985 | Droeser . | |

FOREIGN PATENT DOCUMENTS

| | | | |
|---|---|---|---|
| 5019 | 12/1905 | France | 15/179 |
| 815967 | 10/1951 | Germany | 15/183 |
| 3520307 | 8/1986 | Germany | 15/179 |
| 1251259 | 10/1971 | United Kingdom | 15/182 |

*Primary Examiner*—David A. Scherbel
*Assistant Examiner*—Randall E. Chin
*Attorney, Agent, or Firm*—Watson, Cole, Grindle & Watson

[57] ABSTRACT

A device at cassettes (3) for spring members (4) for a machine proposed i.e. for removing of rubber rests and ice from runways for aircrafts, at which the cassettes (3) are arranged around the periphery on a rotatable roller (1) and extending mainly in the longitudinal direction of the roller (1) and including units (11) of spring members (4), such as radially projecting bristles, the ends of which are brought into contact with the ground, e.g. a runway, at the rotation of the roller (1). Each cassette (3) includes a longish bar (9), which is arranged in facing grooves (8) in brackets (2) extending along the length of the roller (1) and showing passages (8.1) for e.g. removed material, other dusts and water arranged between each groove (8) and the bar (9) extending in the grooves (8).

9 Claims, 3 Drawing Sheets

ROLLER BRUSH FOR SWEEPING MACHINE WITH CASSETTES HAVING METAL REINFORCED MOUNTING PLATE

TECHNICAL FIELD

The present invention concerns a device in cassettes for spring members for a machine, e.g., a sweeping machine, which in one embodiment can be used i.a. for removing of rubber rests, snow and ice from runways for aircraft, in which spring members are manufactured of steel, and which in another embodiment can be proposed for removing snow from railway tracks and switches, in which the spring members are manufactured of plastic. Thus the device is usable for sweeping machines for several different purposes. The cassettes are arranged around the periphery of a rotatable roller and extend mainly in the longitudinal direction of the roller and includes units of spring members, as radially extending bristles, whose ends are brought in contact with the ground, e.g. a runway, by the rotation of the roller. Each cassette includes an elongated bar which is arranged in facing grooves in brackets which extend along the length of the roller.

BACKGROUND TECHNICS

A great number of solutions are known for the fastening of cassettes for bristle bunches arranged around the periphery of a bristle roller, which in turn is rotatably mounted on a sweeping machine or the like. Swedish patent publication SE-B-421 331 describes a bristle roller which provides elongated cassettes in which bunches of bristles are arranged in openings along the length of each cassette. Each cassette is accommodated in grooves extending along the length of the bristle roller and is constituted by two facing U-shaped sheet profiles, which provide facing openings in which bristle bunches are arranged with radially projecting bristles. The sheet profile in the cassette by its weight constitutes a disadvantage as the cassette is exposed to large mass forces with rotation of the bristle roller.

Another embodiment of a bristle roller is disclosed in U.S. Pat. No. 4,538,319. A cassette similar to the one which is described in the patent publication SE-B-421 331 is arranged between brackets which in turn are attached to an elongated roller. The brackets provide grooves for sliding bars, which in turn provide sliding grooves in which the cassettes are accommodated. The sheet profiles in the cassette also are disadvantageous as their weight makes them awkward and give rise to run desirable mass forces with rotation of the bristle roller. The present invention i.a. constitutes an improvement of the device according to U.S. Pat. No. 4,538,319 and is described below.

SUMMARY OF THE INVENTION

The purpose of the present invention is to provide a device according to the preamble above which constitutes an improvement in a cassette for spring members which is possible to use with a bristle roller similar to the one described in the U.S. Pat. No. 4,538,319. The device includes a rotatable roller carrying brackets for the cassettes including units of spring members. Each cassette includes an elongated bar which is arranged in facing grooves in the brackets extending along the length of the roller.

The invention is characterized in that passages for e.g. removed material, other dusts and water are arranged between each groove and the bar extending in the grooves. In a special embodiment of the invention the passages are constituted by a continuous gap or one or more parts of gaps extending along adjacent surfaces on each groove and bar in the cassettes.

By the arrangement of gaps mentioned above a self-cleaning of the rotor with cassettes for spring members has been achieved, at which a clogging by debris or the like between the roller and the underside of the cassette is avoided as between the bar and the grooves in which it is extending. By the arrangement of a gap in this way the work with exchangement of the cassettes is facilitated, e.g., after the spring members in the same have been worn out. As the device, which is described in U.S. Pat. No. 4,538,319, the brackets for the cassettes preferably are provided with sliding bars, providing grooves in which the cassettes are accommodated. In the device according to present invention each cassette also provides a bar of plastic, which partly makes the manufacturing of each cassette cheaper and, partly facilitates the insertion and removal of each cassette during exchange. Further, the bar provides an opening for bunches of spring members along its radially outturned side, which also is provided with a metallic cover. Preferably the cover is constituted by a sheet, preferably a steel sheet, which provides edges which are bent mainly radially inwardly to the center axis of the roller. Further, the cover plate preferably provides collars projecting downwards in openings in the bar. By the cover plate and its edges and collars a reinforcement of the bar against deformation by the forces arising with using of the rotor is achieved. Further a better wear resistance for the pollution passing in the gap between the bar and the corresponding grooves in each bracket of the rotor roller is achieved.

In an alternative embodiment of the invention the sliding bars in the brackets can be excluded when the bar of the cassette is made of plastic, at which an additional increase of the wear resistance to passing pollution and other particles is achieved. The insertion and removal of the cassette in this case is facilitated by the plastic in the bar and its eventually concentrated contact to the grooves in the brackets.

Further characteristics of the invention will be clear from the description of the accompanying drawings.

DETAILED DESCRIPTION OF THE PREFERRED EMBODIMENTS

Figure 1:
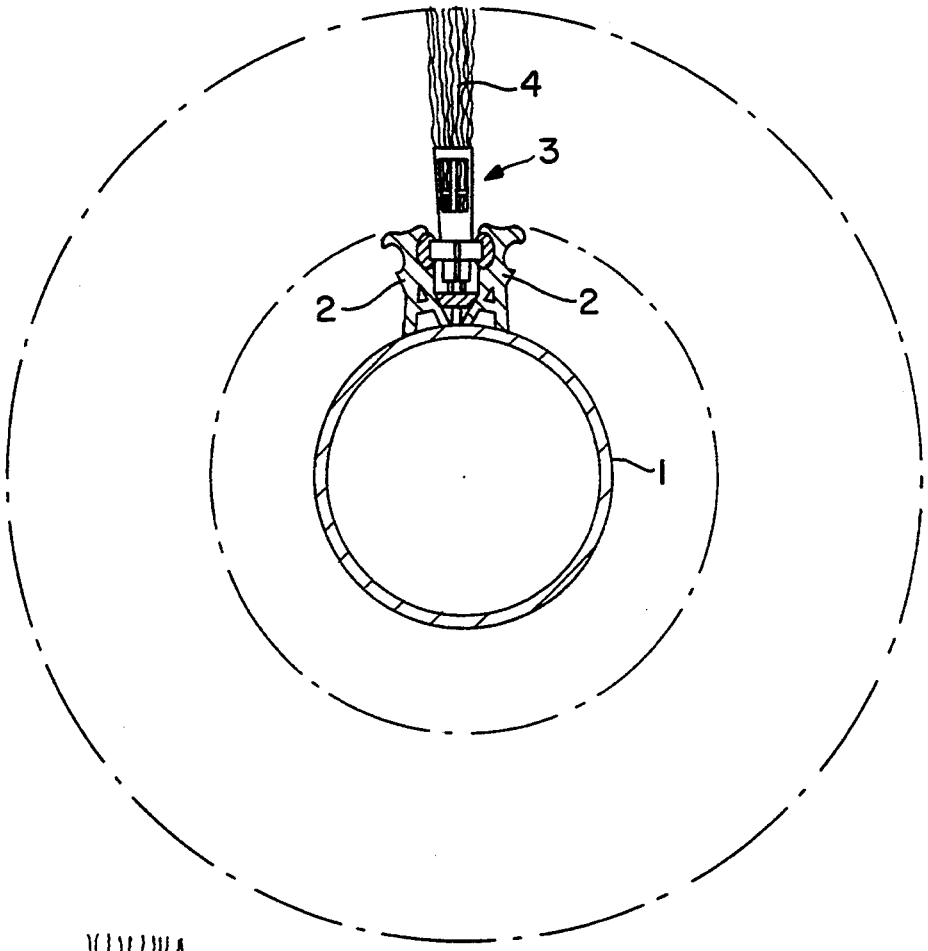
FIG. 1 is fragmentary cross section through a rotor with cassettes carrying spring members.
Figure 2:
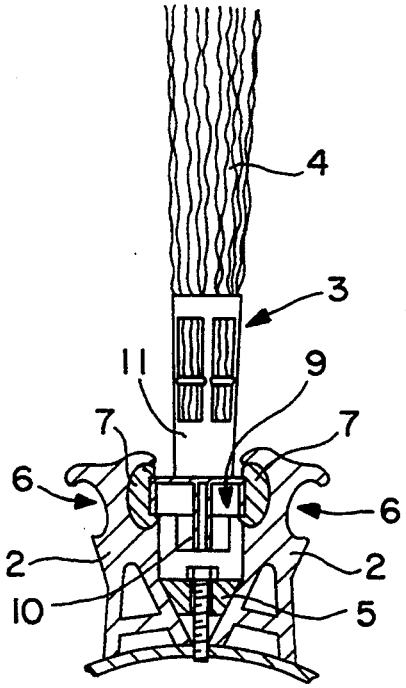
FIG. 2 shows a part of a cassette with spring members mounted in brackets extending along the length of the rotor.
Figure 3:
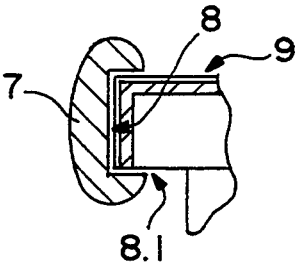
FIG. 3 shows a sliding bar in each bracket in cross section.

A rotor for, e.g. a sweeping machine comprises a cylinder-shaped, elongated roller 1 which carries brackets 2 for elongated cassettes 3 with spring members 4 extending along the length of the roller 1 and arranged close to each other along the periphery of the roller 1. Two adjacent brackets 2 are shown in FIG. 1 and on an enlarged scale in FIG. 2. The brackets 2 are mounted on the roller 1 by means of wedge members 5 which are situated between each bracket 2 and equally spread along the length of the roller 1. These brackets 2 and associated wedge members 5 are known from U.S. Pat. No. 4,538,319 which is mentioned above. The brackets 2 provide grooves 6 on each side, extending along the full length of each bracket 2, in which sliding bars 7 of plastic are arranged. The sliding bars 7 provide facing rectangular sliding channels 8 in which a cassette 3 is accommodated and thereby fill up the space between two brackets 2. A gap 8.1 is arranged between each sliding bar 7 and the intermediate cassette 3. The gap can have a width of 0.1 to 10 mm.

Figure 4:
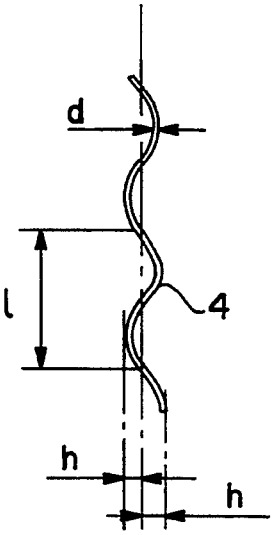
FIG. 4 shows a part of a spring member on an enlarged scale.
Figure 5:
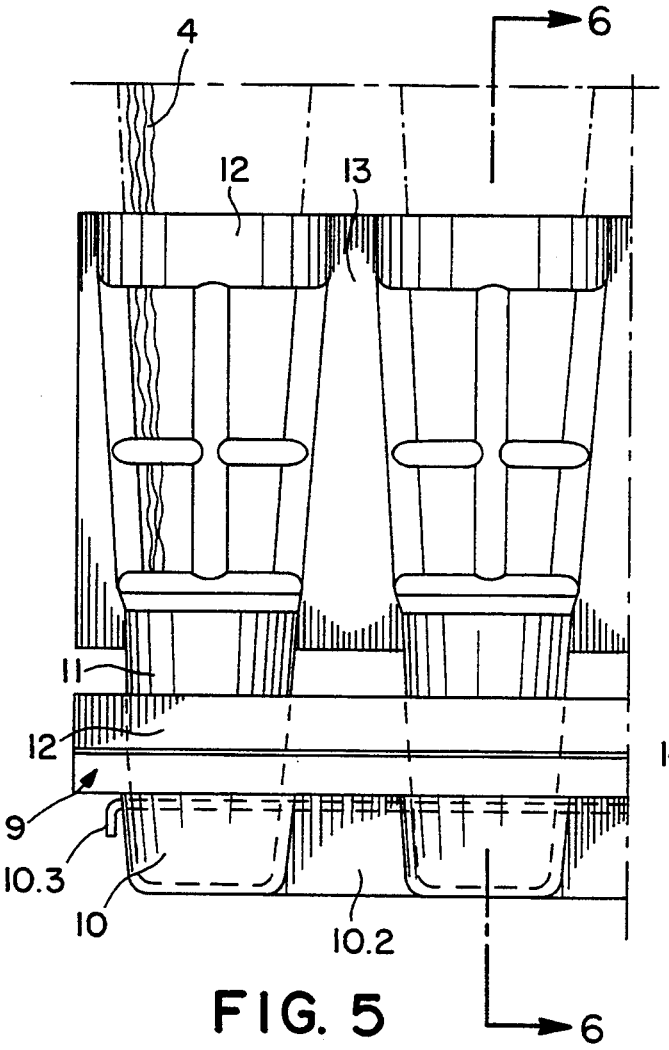
FIG. 5 shows a mounting of spring members in a part of a cassette.
Figure 6:
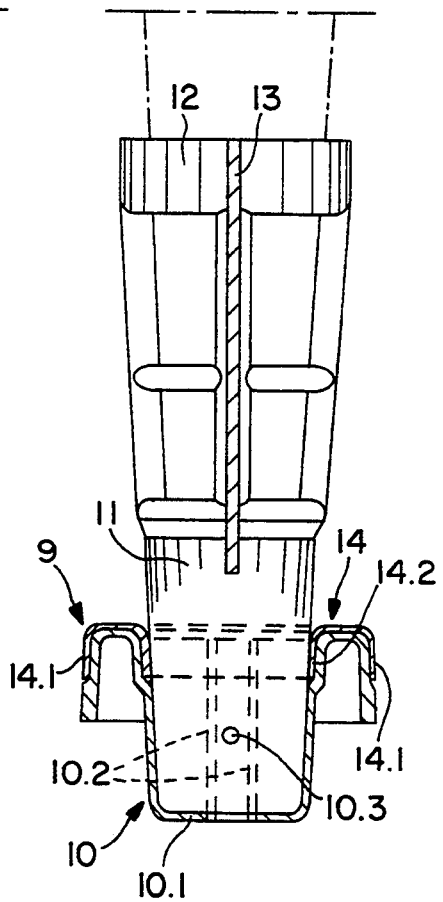
FIG. 6 shows a cross section through the cassette with spring members along the line 6—6 in FIG. 5.

Each cassette 3 includes a bar 9 of plastic, which provides mainly cylinder-shaped, cup-shaped means (cups) 10 equally spread along the length of the bar 9. The cups 10 in turn carry sections of mutually connected cages 11, which extend into the cups 10 and in which spring members 4 are collected in a way making their free ends project from each cage 11. The number of projecting spring members 4 in each cage 11 is 100–400 and have a diameter of 0.1–2.0 mm, particularly 0.3–1.0 mm. They have a tensile strength of at least 180 kp/mm.$^2$ Each spring member 4 is constituted by a steel wire having a characteristic diameter (d), waves with a wavelength (l) and a waveheight (h) as shown in FIG. 4 and with the following dimensions:

length = two to twenty times diameter, preferably up to 5 times diameter height = about 1.5 to 3 times diameter A bar 9 of a cassette 3 is shown in section in FIG. 5 and in cross section in FIG. 6. The bar 9 which is shown in the figures has a mainly rectangular downwardly open cross section. The cups 10 are arranged projecting down from the upper side of the bar 9 and are provided with a bottom 10.1. Between the cups 10 two mutually parallel supporting walls 10.2 extend, which partly serve as a stiffener of the bar 9, and partly constitute a guide for a locking wire 10.3 which during mounting of the cages is brought through holes in facing sides of the cups 10 and through cages 11 with spring members 4 which are brought down into the cups 10. Further, the cages 11 are provided with upwardly projecting basket-like means (baskets) 12, which in turn are mutually connected with a connecting wall 13. The bar 9 with the cups 10 and the cages 11 with spring members 4 attached therein is known, as is the device to lock the parts together to a cassette 3.

Figure 7:
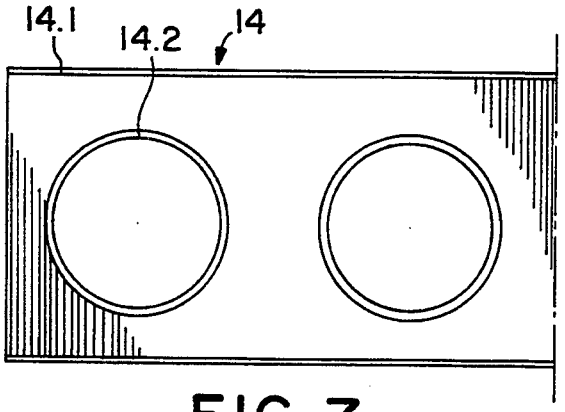
FIG. 7 separately shows a cover plate to the cassette with spring members according to FIGS. 5 and 6.

The bar 9 shown in FIGS. 5 and 6 further is provided with a cover plate 14, which provides edges 14.1, which are bent mainly radially inwardly toward the roller 1 along the two parallel sides of the bar 9, and collars 14.2 projecting down into the openings at each cup 10 in the bar 9. Preferably the cover plate 14 is constituted by a steel sheet, which increases the stiffness of the bar 9 and its capacity to take up forces from the spring members 4 when they rotate with the rotor and are brought in contact with the ground. A separate cover plate 14 is shown in FIG. 7 from below. The cover plate 14 can extend over the full length of the bar 9.

Figure 8:
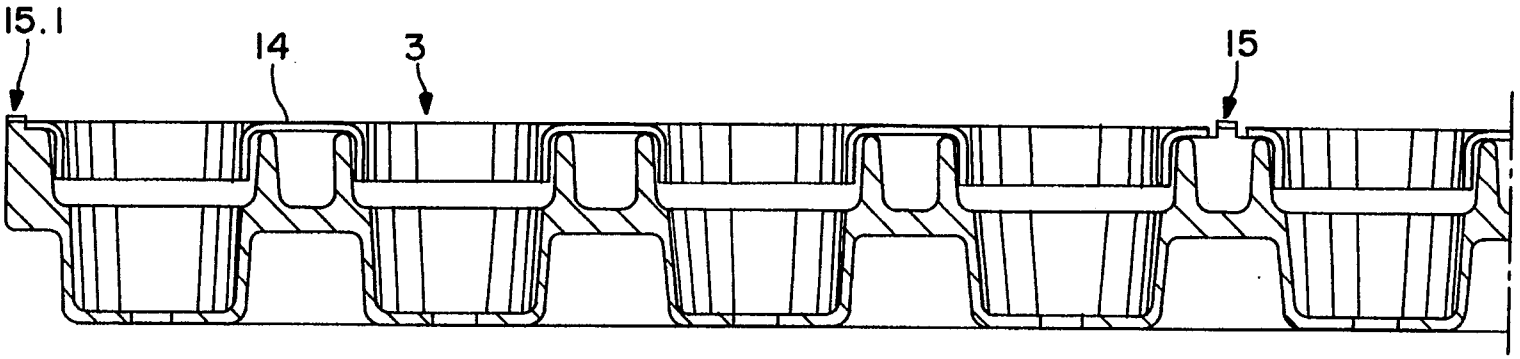
FIG. 8 shows an alternative embodiment of a cassette in a longitudinal section and without spring members.
Figure 9:
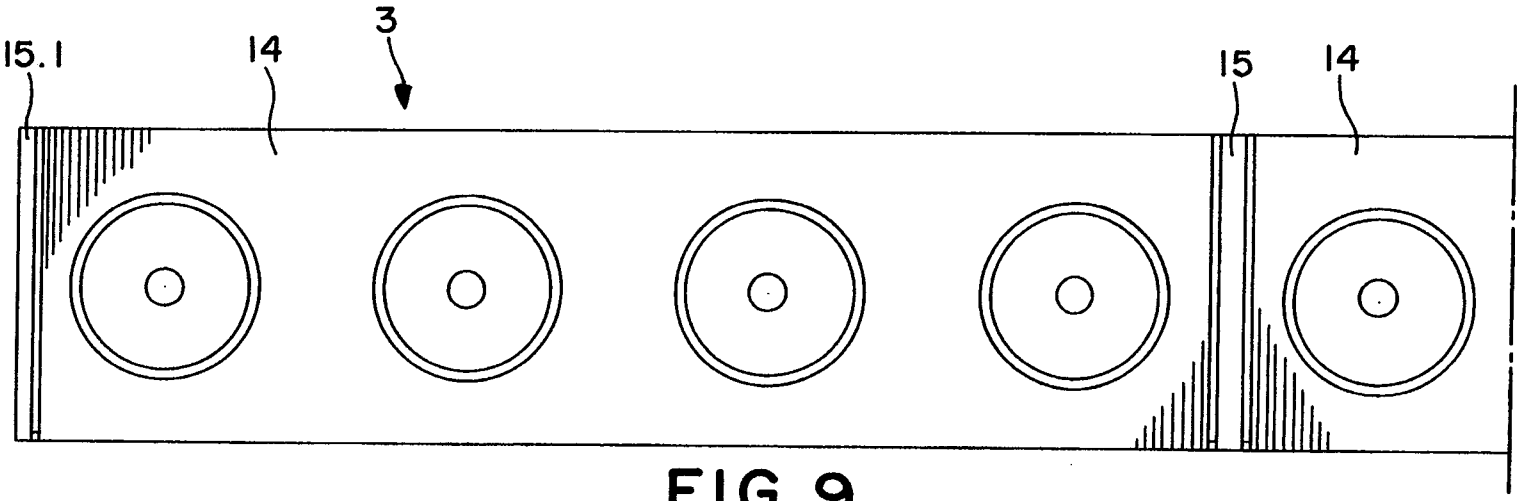
FIG. 9 shows the cassette according to FIG. 8 in a plan view.

In an alternative embodiment of the invention, which is shown in FIGS. 8 and 9, the cassette 3 includes a bar 9 of plastic as above, but is provided with several cover plates 14 arranged at a mutual distance. In the embodiment shown, each part-cover plate 14 comprises four cages 11 with spring members 4 put together in one unit by the connecting walls 13. At each distance the bar includes a projecting party 15 projecting from the surface of a cover plate about 0.2 mm, by which parties 15 the bar 9 can be pushed into the sliding bars 7 without the cover plate coming in contact with the same. At each end of the bar 9 a projecting party 15.1 is arranged. An insertion of a cassette 3 in the brackets 2 by this can be made with a very low frictional resistance and eventually burrs on the cover plate 14 are prevented from damaging the sliding bars 7. The projecting parties 15 are worn out during the work of the roller 1. In this embodiment of the invention the sliding bars 7 of plastic can be excluded by that each cassette 3 can slide on the projecting parties 15, 15.1 at insertion in the brackets 2 on the roller 1.

In another alternative embodiment of the invention, not shown in the figures, the cover plate 14 can be replaced by a collar-like reinforcement projecting down into the bar on each cassette. This embodiment is usuable at proportionally low strains on the spring members as, e.g., at easy sweeping works.

The embodiments of the invention described give a very solid cassette which permits high rotation speed of the roller in use. A roller of a diameter of 300 mm can be given a rotation speed of 600–1000 r/min, which corresponds to a periphery speed of about 600–1000 m/min.

I claim:

1. A roller brush for a sweeping machine used to clean surfaces such as runways, railways and switches, the roller brush including an elongated roller; a plurality of pairs of elongated brackets mounted about a circumference of the roller so as to extend generally longitudinally thereof, said pairs of brackets defining generally facing grooves; and a plurality of cassettes mounted between respective pairs of brackets, each cassette comprising an elongated mounting bar Which includes a main portion and a plurality of spaced apart, upwardly open cups which extend from said main portion towards said roller, each said cassette also including a plurality of cages respectively mounted in said cups and respectively supporting bundles of radially-outwardly extending spring members, wherein each said mounting bar is mounted between a pair of brackets to provide a gap on each side thereof for the removal of debris and liquid, wherein each mounting bar is made of plastic, and including a reinforcing metal sheet on at least the main portion of said mounting bar.

2. The roller brush of claim 1, wherein said gap has a width of 0.1 to 10 mm.

3. The roller brush of claim 1, wherein said mounting bar includes lateral flange parts which extend toward said roller, and wherein said reinforcing metal sheet includes lateral portions which extend over portions of said lateral flange parts of said mounting bar.

4. The roller brush of claim 1, wherein said reinforcing metal sheet includes collars which project downwardly into said cups.

5. The roller brush of claim 1, wherein each cage includes 100 to 400 spring members.

6. The roller brush of claim 5, wherein each spring member has a diameter of 0.1 to 2.0 mm and a tensile strength of at least 180 kp/mm.

7. The roller brush of claim 5, wherein said spring members are made of metal.

8. The roller brush of claim 5, wherein said spring members are made of plastic.

9. The roller brush of claim 5, including sliding bars mounted in said facing grooves of each pair of brackets, said sliding bars defining channels in which said mounting bar extends.

* * * * *